United States Patent [19]

Renaut

[11] 4,163,331

[45] Aug. 7, 1979

[54] MACHINE FOR IRONING A SHOULDER AND A SLEEVE OF A GARMENT

[75] Inventor: Henry Renaut, Roubaix, France

[73] Assignee: Societe Anonyme dite: LEMAIRE, France

[21] Appl. No.: 804,380

[22] Filed: Jun. 7, 1977

[30] Foreign Application Priority Data

Jul. 26, 1976 [FR] France ..... 76 23291

[51] Int. Cl.[2] ..... D06F 71/40

[52] U.S. Cl. ..... 38/12; 223/67; 223/70; 223/73

[58] Field of Search ..... 38/12, 14; 223/63, 67, 223/70, 73, 74, 61, 65, 72, 71

[56] References Cited

U.S. PATENT DOCUMENTS

| | | | |
|---|---|---|---|
| 1,020,502 | 3/1912 | Hinkel | 223/74 |
| 1,345,739 | 7/1920 | Bank | 223/74 |
| 1,990,454 | 2/1935 | Johnston | 223/73 X |
| 2,327,492 | 8/1943 | Braun | 38/12 UX |
| 2,698,705 | 1/1955 | Hitz | 223/67 X |
| 3,250,446 | 5/1966 | Von Soder et al. | 223/63 |
| 3,715,064 | 2/1973 | North et al. | 223/70 X |

FOREIGN PATENT DOCUMENTS

| | | | |
|---|---|---|---|
| 98398 | 7/1898 | Fed. Rep. of Germany | 223/73 |
| 1138015 | 10/1962 | Fed. Rep. of Germany | 223/70 |

*Primary Examiner*—Werner H. Schroeder
*Assistant Examiner*—Moshe I. Cohen
*Attorney, Agent, or Firm*—Robert E. Burns; Emmanuel J. Lobato; Bruce L. Adams

[57] ABSTRACT

A "stretcher" machine for ironing the shoulder, armhole and sleeve of an upper garment comprises a former and a stretcher. The former has an outer shape corresponding to the contour of at least one shoulder for carrying the garment in the wearing position. Means are provided for injecting steam and/or air at least into the interior of the sleeve when the garment is placed on the former. The stretcher is generally elongate and is firmly fastened to the former so as to occupy, in relation thereto, the natural position of an arm relative to the chest. The stretcher is arranged to engage longitudinally within the sleeve of the garment and to match the interior shape of the sleeve by tensioning the sleeve transversely. The means for injecting steam and/or air terminates within the stretcher and the stretcher comprises means for passing steam and/or air to the exterior and to the sleeve positioned on the stretcher.

16 Claims, 3 Drawing Figures

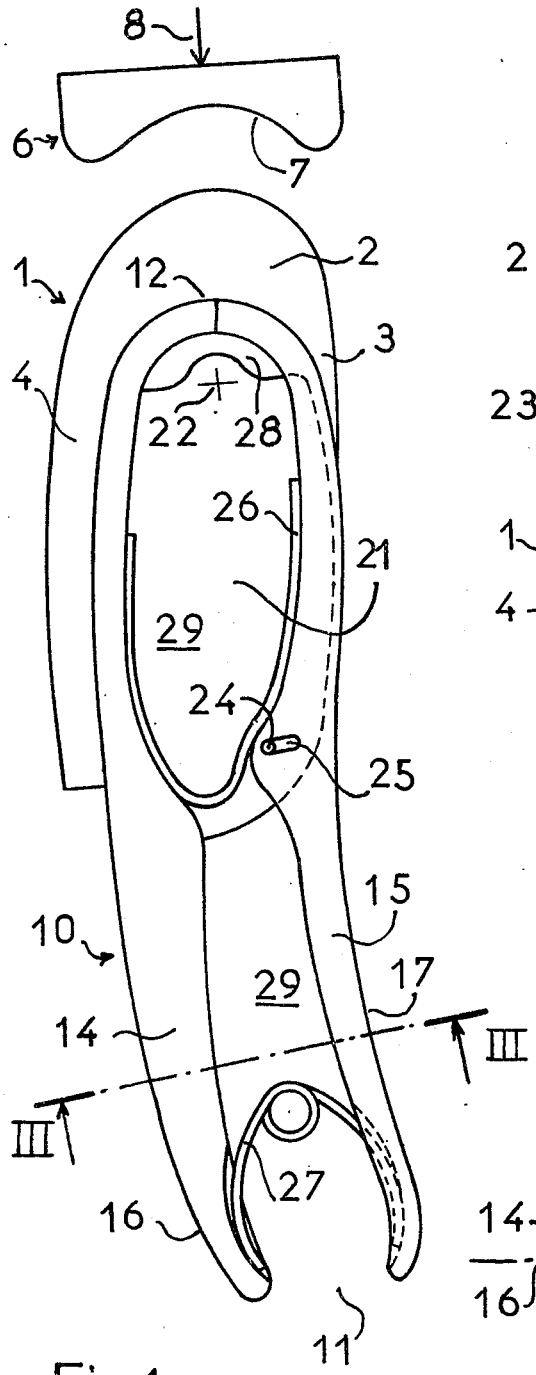
Fig.1
Fig.2
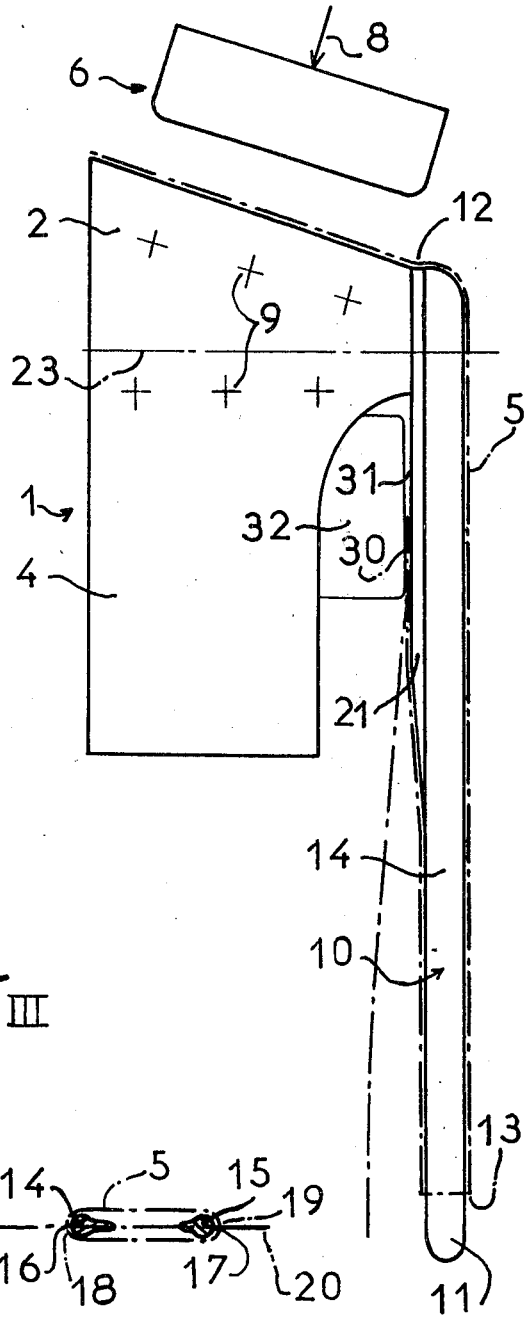
Fig.3

MACHINE FOR IRONING A SHOULDER AND A SLEEVE OF A GARMENT

BACKGROUND OF THE INVENTION

The present invention relates to a machine known as a "stretcher" for ironing upper garments at least in a zone corresponding to a shoulder, arm-hole and sleeve.

Known machines of this kind comprise a former, shaped to the contour of at least one shoulder, for accommodating the garment in the wearing position, and a co-operating part positioned opposite this former and matching the exterior shape of the former and the garment carried by it. The co-operating part is adapted to apply pressure to the former and the garment. These machines also incorporate suitable means for injecting steam and/or air into the pressed zone in accordance with a predetermined ironing cycle.

Means are also provided for injecting steam and/or air into the interior of the sleeve, which is stretched in a transverse direction by means of a device generally constituted by two wooden blades which are urged away from each other by a spring, the sleeve being brought into a position corresponding to a natural wearing position in relation to the former by securing its lower end to the frame of the machine, generally by means of a clamp.

This known type of machine has a number of disadvantages. Firstly, the wooden stretching blades have to be fitted in the sleeve through the lower end thereof and then this lower end of the sleeve has to be secured to the machine which calls for additional manipulation when positioning the garment.

Also, it is difficult to bring the wooden blade stretcher and the fixing point for the sleeve into the correct positions, so that the sleeve does not always have the required "fall" after ironing has been completed. In particular, deformation of the cloth of the sleeve is often observed at the terminal zones of the blades of the stretcher.

Deformation of the cloth is also sometimes observed at the lower portion of the arm-hole which is generally pressed between the former and a rigid plate connected to the former by resilient means which press it against the former. In fact, there is not necessarily correspondence between the shape imparted to this portion of the sleeve by the two rigid pressing parts and the shape that tends to be imparted to the entire sleeve by the stretcher placed within the sleeve and the clamp for holding the sleeve in the natural wearing position.

The aim of the present invention is to eliminate all of these disadvantages by providing a machine for ironing upper garments at least in a zone corresponding to a shoulder, arm-hole and sleeve.

SUMMARY OF THE INVENTION

The present invention provides a machine for ironing upper garments at least in a zone corresponding to a shoulder, arm-hole and sleeve, the machine comprising a former having an outer shape corresponding to the contour of at least one shoulder for carrying the garment in the wearing position, means for injecting steam and/or air at least into the interior of the sleeve when the garment is placed on the former, and a longitudinal stretcher firmly connected to the former and occupying, in relation thereto, the natural position of an arm in relation to the chest, the stretcher being arranged to engage longitudinally within the sleeve of a garment and to match the interior shape of the sleeve by tensioning the sleeve transversely, wherein said means for injecting steam and/or air terminates within the stretcher, and wherein the stretcher comprises means for passing steam and/or air to the exterior and to the sleeve positioned on the stretcher.

Thus, the machine has a stretcher which is firmly connected to the former and occupies, in relation to the former, a generally adjustable position which corresponds to the natural position of the arm in relation to the chest, the sleeve and shoulder of the garment being immediately brought into position, without any additional operation, when the garment is fitted on to the machine in a manner resembling the natural procedure adopted when a wearer puts on a garment. Furthermore, the operation of placing the stretcher within the sleeve, which consists of threading the sleeve over the fixed stretcher is much more convenient since the operator does not have to twist his body to introduce the stretcher through that end of the sleeve remote from the arm-hole.

It is also possible for the stretcher to be of such shape that it matches the interior of the sleeve over its entire length from its lower end to the upper portion of the arm-hole, the stretcher element then forming one of the elements for pressing the lower portion of the arm-hole. Thus, the machine in accordance with the invention makes it possible to avoid the deformation usually observed in the cloth at the terminal zone of the stretcher.

The other element for pressing the lower portion of the arm-hole preferably takes the form of an inflatable pad which is generally made of a flexible semi-permeable material so that steam and/or air can be injected towards the arm-hole by way of this pad. An inflatable pad of this kind offers the twofold advantage of enabling the garment to be placed in position more easily since there is no need to force the lower portion of the arm-hole between two resiliently interconnected rigid parts, and of enabling the pad to adapt itself precisely to the shape of the arm-hole and of the adjacent portions of the garment to be ironed, thus avoiding the creases and deformation that occur when using rigid pressing elements of more limited dimensions.

The other portions of the sleeve can be ironed by injecting steam and/or air into the interior of the stretcher which is of a suitable shape that permits the steam and/or air to reach all the portions of the cloth of which the sleeve is made.

The bust or chest portion of the garment is ironed in the conventional manner by being pressed between the former and a co-operating part of any suitable kind, and by injecting steam and/or air through the cloth in this zone in accordance with any known cycle.

BRIEF DESCRIPTION OF THE DRAWINGS

One form of "stretcher" machine constructed in accordance with the invention will now be described, by way of example, with reference to the accompanying drawings, in which:

FIG. 1 is a side view of the machine which is designed to iron the right shoulder, arm-hole and sleeve of an upper garment such as a jacket or coat;

FIG. 2 is a rear view of the machine; and

FIG. 3 is a cross-section through the two blades of the stretcher on the line III—III of FIG. 1.

DESCRIPTION OF PREFERRED EMBODIMENT

The machine illustrated in particular in FIGS. 1 and 2 is designed for ironing the right shoulder, arm-hole and sleeve of a garment. A similar machine could of course be provided for ironing the left shoulder, arm-hole and sleeve. Moreover, it is also possible to design a single machine for ironing both shoulders, both sleeves and both arm-holes, without thereby departing from the scope of the invention.

The machine illustrated in FIGS. 1 and 2 comprises a former 1 the shape of which corresponds to the shape of the right shoulder, at 2, and to adjacent portions of the upper torso, that is to say the front portion, at 3, and the rear portion at 4.

This former 1 is designed to carry the garment in the natural wearing position, as shown diagrammatically by a dash-dot line 5 in FIG. 2, and to enable ironing to be carried out at the shoulder and over zones adjacent thereto.

For this purpose a press plate 6 is arranged opposite that zone 2 of the former 1 corresponding to the shoulder, and the press plate has a portion 7 the shape of which is complementary to that of the zone 2. Means indicated by the arrow 8 press the portion 7 of the plate 6 on to the zone 2 of the former 1, the garment being placed between the plate and the former so as to press it.

Formed within the plate 6 and/or the former 1 at the zone of the shoulder 2 are chambers within which terminate means for injecting steam and/or air, these chambers communicating with the atmosphere by way of orifices 9 formed in the zone 2 of the former 1 and in the surface 7 of the plate 6 so as to enable the garment to be steamed and dried in known manner and in accordance with a known cycle.

A longitudinal stretcher 10 adapted to be introduced lengthwise into the right sleeve of the garment and to match the interior of the sleeve by imparting transverse tension thereto, is solidly connected to the former 1 and at a position relative thereto that is similar to the natural position of the arm in relation to the chest or bust.

This stretcher 10 is designed to shape the sleeve and it comprises means for injecting steam and/or air into the sleeve, in known manner, in order to iron the sleeve.

Referring to FIG. 2, the longitudinal dimension of this stretcher 10 such that it closely fits inside the sleeve over the entire length thereof, from the upper portion 12 of the arm-hole to the end 13 of the sleeve, though the lower end 11 of the stretcher preferably extends beyond the bottom of the sleeve.

In the example illustrated, the stretcher 10 consists of two longitudinal complementary blades 14 and 15 which are substantially coplanar and are positioned one behind the other. Each of these blades 14 and 15 defines an edge 16 and 17 respectively, one directed rearwardly and the other forwardly, these edges representing the shape to be imparted to the rear and front longitudinal creases 18 and 19 of the sleeve (see also FIG. 3).

The shape of the edges 16 and 17 will be selected by the expert to suit the cut of the garment to be ironed and the requirements of fashion, which factors determine the shape to be imparted to the sleeves of the garment.

In the example illustrated, the blades 14 and 15 complement each other in such a manner as to fit closely within the sleeve including the zone of the arm-hole 12, and the edges 16 and 17 are extended as far as this area and they are of suitable complementary shape.

To enable the blades 14 and 15 to move relatively to each other along a plane 20, common to both of them, so as to tension the sleeve in the transverse direction, only the rear blade 14 is secured to the former 1. In practice, the blade 14 is secured to a plate 21 arranged substantially parallel to the main plane 20 of the stretcher and facing the former 1 to which it is secured.

In order to adjust the position of the entire stretcher 10 in relation to the former 1 so as to bring the sleeve into its natural wearing position the plate 21 is connected to the former 1 by a hinge 22, the pin of which extends along a horizontal axis 23 of the former 1, the stretcher 10 being pivotable about this hinge pin. The axis 23 is at right-angles to the main plane 20 of the stretcher. In relation to the stretcher 10 and the former 1, the hinge 22 occupies a position which is as close as possible to that at which the human arm is joined to the upper part of the torso.

In the example illustrated, the front blade 15 is mounted to rotate and pivot on the blade 21 solidly connected to the blade 14 so that the blade 15 is enabled to occupy a position, relative to the blade 14, suitable for enabling the stretcher to fit, as closely as possible, the interior of the sleeve to be ironed, to which sleeve the blades apply transverse tension.

For this purpose the blade 14 carries, by way of the plate 21, a stud 24 which extends substantially at right-angles to the main plane 20 of the stretcher and the blade 15 contains a slot 25 which is adapted to receive the stud and extends substantially at right-angles to the general direction of the stretcher and in the plane thereof. This enables the blade 15 to rotate relatively to the blade 14 in the plane 20 of the stretcher and, on the other hand, to permit this blade 15 to slide backward or forward relative to the blade 14 and likewise in the plane 20 of the stretcher. The stud 24 and the slot 25 are located substantially midway along the stretcher and the blades.

To urge the two blades 14 and 15 apart so as to put the sleeve under transverse tension, two springs 26 and 27, having a spreading action, are fitted between the blades, one spring being located above and the other below the stud 24 and the slot 25. This spring arrangement of course represents only one example, and other means could be provided for resiliently urging apart the edges 16 and 17 of the blades 14 and 15.

As stated above, to enable steam and/or air to be injected into the cloth of the sleeve for the purpose of ironing the latter, the injection means terminate within the stretcher 10 which injection means comprises devices for diffusing the steam and/or air throughout all of the cloth forming the sleeve.

In the example illustrated, the plate 21 has an opening 28 in its upper portion close to the hinge 22, this opening causing the space 20 separating the two blades, to communicate with an interior chamber (not illustrated) in the former 1. Into this chamber runs means for injecting air and/or steam, which means, known per se, are not illustrated in the drawings.

Thus, the steam and/or air introduced into the interior chamber of the former 1 is also introduced betweem the two blades 14 and 15 of the stretcher 10 along the entire length thereof, the intermediate space 29 being closed off by the sleeve when the latter is positioned on the stretcher 10.

To enable the steam and/or air, injected into the space 29 through the opening 28, to pass through all the material of which the sleeve is made, including the edges 16 and 17, while providing the two blades 14 and 15 with transverse dimensions such that they have sufficient mechanical strength, the blades 14 and 15 are, in the example illustrated, of spherical lune cross-section, as shown in FIG. 3. The sleeve, which occupies its natural wearing position in relation to the upper portion of the torso, can thus be ironed in good conditions.

At the lower portion 30 of the arm-hole, which is fitted against a surface 31 of the plate 21 which faces the exterior of the intermediate space 29 in the stretcher 10, ironing can be carried out by means of an inflatable pad 32 which is fitted at this level between the plate 21 and the former 1, so that when it is deflated, the garment can be readily fitted on the machine, whereas when the pad is inflated, the lower portion 30 of the arm-hole can be pressed against the surface 31 of the plate 21.

The material of which the pad 32 is made is flexible, so that it can be inflated and deflated but the material is also semi-permeable. Means for injecting steam and/or air (not illustrated) run into the interior of the pad 32, and the semi-permeability of the pad enables it to be inflated when steam and/or air are injected and it also affords passage to the steam and/or air towards the cloth of the lower portion 30 of the arm-hole.

Other means for ironing the lower portion 30 of the arm-hole could of course be envisaged, but the pad 32 has the advantage of being able to adapt itself precisely to the shape of the garment to be ironed without applying too much pressure to certain zones, and without applying too little pressure in other zones, at the risk of deforming the garment. Also, the pad 32 could be extended beyond the zone of the former 1, arranged opposite the plate 21, so as to ensure that chest zones of the garment that are located adjacent the lower portion of the arm-hole and particularly to the rear and/or front thereof, are also ironed.

The machine described above may of course be modified in a large number of ways without departing from the scope of the invention. In particular modifications could be made to the construction of the stretcher 10, the method of hinging it on the former 1, the means for adapting the stretcher to the shape of the sleeve to be ironed, and the means for injecting steam and/or air into the sleeve for ironing it.

I claim:

1. A machine for ironing upper garments at least in a zone comprising a shoulder, armhole and sleeve, said machine comprising a hollow former having an outer shape corresponding to the contour of at least one shoulder of the garment in wearing position, and a stretcher for stretching the sleeve of the garment, said stretcher comprising first and second elongate members arranged to extend longitudinally inside a sleeve of a garment placed on said former, from said former to and beyond the lower end of the sleeve, means hingedly connecting said first member to said former for movement about a horizontal axis lying approximately in the median plane of said former, means interconnecting said first and second members for movement toward and away from one another and for angular movement relative to one another and tensioning means for resiliently urging said elongate member apart, said sleeve stretcher being arranged to engage longitudinally within the sleeve of a garment placed on said former and to match the interior shape of the sleeve by tensioning the sleeve transversely by the action of said tensioning means.

2. An ironing machine according to claim 1, in which said members of said sleeve stretcher comprise elongate blade portions engageable with said sleeve, and said first member further comprises a plate portion which is hingedly connected to said former.

3. An ironing machine according to claim 2, in which said first member of said sleeve stretcher is positioned to engage a rear portion of a sleeve of a garment being ironed and said second member is positioned to engage a forward portion of said sleeve.

4. An ironing machine according to claim 2, in which said plate portion of said first member of said sleeve stretcher has an opening providing communication for the passage of steam or air from the interior of said former to space between said blade portions of said members.

5. An ironing machine according to claim 2, in which said means interconnecting said members comprises a pin-and-slot connection between said second member and said plate portion of said first member, the slot of said connection extending transversely of the length of said members to provide for movement of said members toward and away from one another, said pin-and-slot connection further providing pivotal movement of said members relative to one another in the plane of said plate portion of said first member.

6. An ironing machine according to claim 5, in which said pin-and-slot connection comprises a slot in said plate portion of said first member and a pin on said second member.

7. An ironing machine according to claim 5, in which said pin-and-slot connection between said members of said sleeve stretcher is located about midway of the length of said members.

8. An ironing machine according to claim 7, in which said tensioning means comprises a first spring above said pin-and-slot connection and a second spring below said pin-and-slot connection, said springs acting respectively between upper and lower portions of said members to urge them away from one another.

9. An ironing machine according to claim 2, further comprising a pressure pad for pressing a lower armhole portion of a garment against said plate portion of said first member of said sleeve stretcher.

10. An ironing machine according to claim 9, in which said pressure pad is of flexible material and means is provided for inflating said pad with steam or air.

11. An ironing machine according to claim 10, in which said flexible material of said pressure pad is semi-permeable to permit restricted passage of steam or air through said material to the portion of a garment engaged by said pad.

12. An ironing machine according to claim 1, in which said members of said sleeve stretcher comprise elongate blades each of which in cross section comprises a rounded portion for engagement with the sleeve of a garment and a fin portion extending inwardly from said rounded portion toward the other of said members.

13. An ironing machine according to claim 1, in which said members of said sleeve stretcher comprise elongate blades having rounded sleeve-engaging portions spaced apart from one another and in which means is provided for the passage of steam or air from the interior of said former to the space between said sleeve-engaging portions of said blades.

14. An ironing machine according to claim 13, in which lower end of said blade portions curve inwardly toward one another.

15. An ironing machine according to claim 1, in which said tensioning means comprises a first spring means acting between upper portions of said members of said sleeve stretcher and second spring means acting between lower portions of said members, said spring means biasing said members away from one another.

16. An ironing machine according to claim 1, in which said members of said sleeve stretcher comprise inwardly curved upper portions conforming to an upper portion of a sleeve of a garment above the armhole and elongate blade portions extending downwardly from said curved upper portions to and beyond the lower end of said sleeve.

* * * * *